United States Patent [19]

Meyer et al.

[11] 4,029,923

[45] June 14, 1977

[54] MAGNETIZING CURRENT SWITCH

[75] Inventors: Jeffry R. Meyer, Pittsburgh; Sylvester J. Dropik, Jeannette both of Pa.

[73] Assignee: Westinghouse Electric Corporation, Pittsburgh, Pa.

[22] Filed: Jan. 15, 1976

[21] Appl. No.: 649,181

[52] U.S. Cl. ..... 200/163; 200/16 B; 200/148 B; 335/72

[51] Int. Cl.[2] ..... H01H 1/44

[58] Field of Search ..... 200/16 R, 16 B, 48 R, 200/148 R, 148 B, 148 D, 148 F, 153 G, 163; 335/68, 72

[56] References Cited

UNITED STATES PATENTS

| | | | |
|---|---|---|---|
| 3,562,465 | 2/1971 | Turgeon | 200/163 |
| 3,778,574 | 12/1973 | Clark | 200/148 B |
| 3,794,799 | 2/1974 | Spindle et al. | 200/153 G |
| 3,801,768 | 4/1974 | Meyer | 200/163 |
| 3,876,846 | 4/1975 | Graybill | 200/148 B |
| 3,987,260 | 10/1976 | Wilson | 200/148 B |

*Primary Examiner*—Volodymyr Y. Mayewsky
*Attorney, Agent, or Firm*—M. S. Yatsko

[57] ABSTRACT

A magnetizing current switch particularly adaptable for use in gas insulated substations comprising a sealed housing including two spaced-apart electrical conductors and a movable contact for electrically connecting or disconnecting the electrical conductors. A rotatable drive shaft is coupled to drive means, which translate the rotation of the drive shaft to a generally straight-line motion, and the straight-line motion moves an insulating rod which is secured to the contact, thereby positioning the contact either in contact with both conductors, or spaced apart from at least one of them. The drive means includes a pair of support members and a pair of spaced-apart pivot links pivotally coupled to the support members. One of the pivot links is coupled to the drive shaft, and a link connector couples the pivot links together. The link connector can rotate within the pivot link openings provided therein, and upon pivotal movement of the pivot links, the link connector experiences both an arcuate and a rotational movement. Spaced-apart drive arms fixedly secured to the link connector cooperate with the insulating rod, and upon the arcuate and rotational movements of the link connector, the free end of the drive arm traverses a substantially straight line, thereby moving the insulating rod and the movable contact.

11 Claims, 7 Drawing Figures

MAGNETIZING CURRENT SWITCH

BACKGROUND OF THE INVENTION

This invention relates generally to switching apparatus and more particularly to a magnetizing current switch particularly adapted for use with gas insulated power transmission systems.

In recent years, there has come about a demand for a reduced-size substation. This demand on the part of public utilities has been met by gas insulated substation equipment. This type of substation equipment significantly reduces the space required by the high voltage side of substations rated, for example, 46 KV through 500 KV. Space reduction is accomplished by replacing the open-bus and air-tight bushings with gas insulated bus filled, for example, with a highly insulating gas such as sulfur-hexafluoride gas at a pressure, for example, for 45 pounds per square inch gauge, and thereby permitting the movement of electrical equipment very closely together.

This gas insulated substation equipment has many advantages, among which are: significant reduction in space requirements both in land area and overall height; added system reliability by eliminating the possibility of phase-to-phase faults, lightning strokes within the system, or contamination of insulators; reduced maintenance because the closed system is isolated from the environment; added personnel safety because all live parts are covered by grounded shields; and lower installation costs as compared with conventional or other types of power systems when the gas insulated modular approach is utilized.

The gas insulated system, as briefly described above, has additional design strategies, inasmuch as the high voltage equipment is compressed, so that both the space required and the total length of bus is minimized. The power transformers may be located on outside corners so as to be capable of ready removal, and the location of cable parts is flexible, with result that the system may be readily connected to overhead transmission lines.

It is desirable to provide a magnetizing current switch, which will permit the isolation of certain sections of the gas insulating system, and is obvious, quick opening and quick closing of the magnetizing current switch is desirable. Additionally, the magnetizing current switch must be capable of functioning in its installed environment. For example, specifications may require that the magnetizing current switch be capable of a continuous current rating of 2500 amperes, and a switching current rating of 35 amperes.

SUMMARY OF THE INVENTION

Briefly stated, this invention provides magnetizing current switch particularly adapted for use in gas insulated transmission systems comprising a sealed housing including two spaced-apart electrical conductors, and a movable contact disposed within the housing. The movable contact is capable of being in at least two positions; one position in electrical contact with both conductors, thereby permitting the flow of electricity therebetween; and a second position wherein the movable contact is spaced apart from at least one electrical conductor, thereby prohibiting the flow of electricity between conductors. The movable contact is secured to a movable insulating rod, which in turn is coupled to a drive means. The drive means are utilized for positioning the movable contact with respect to the electrical conductors, and translate a rotational movement from a drive shaft to a generally straight-line motion. The straight-line motion of the drive means is transmitted through the insulating rod to the movable contact to position the contact in one of two contact positions.

BRIEF DESCRIPTION OF THE DRAWINGS

Reference is now made to the Description Of The Preferred Embodiment, illustrated in the accompanying drawings, in which.

DESCRIPTION OF THE PREFERRED EMBODIMENT

Figure 1A:
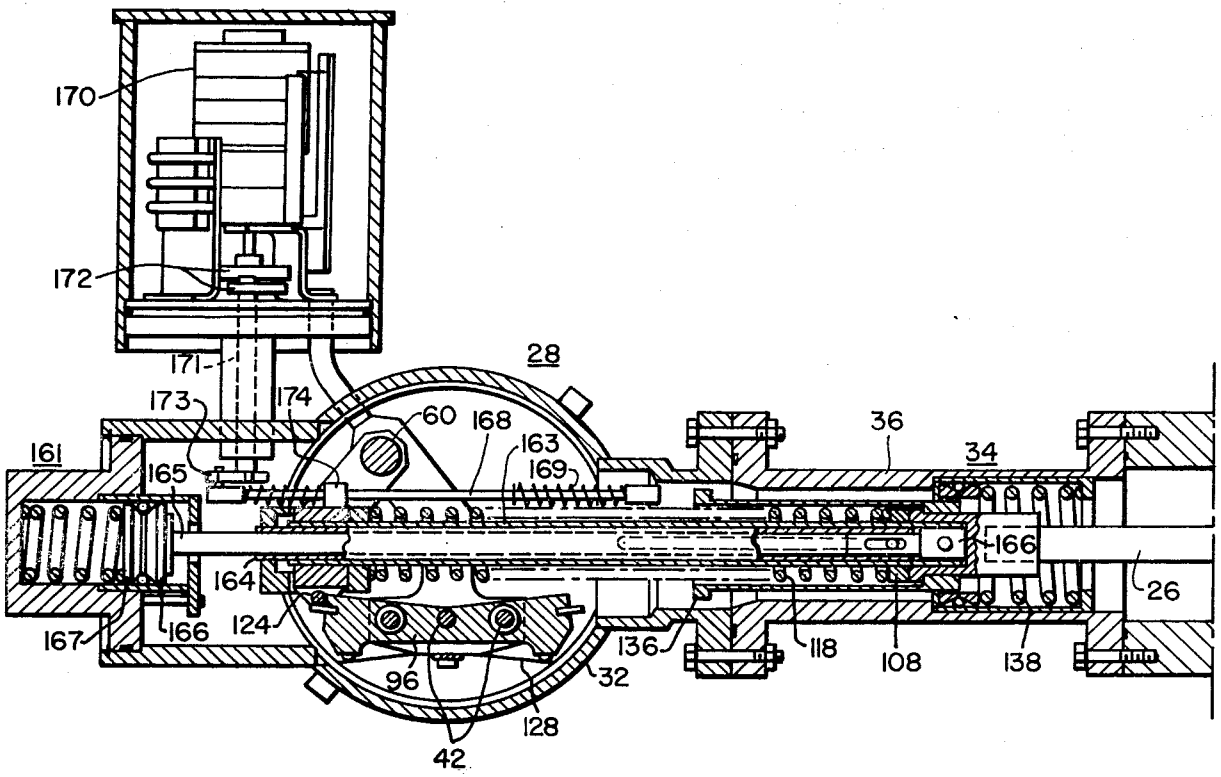
FIG. 1 is a longitudinal, vertical, sectional view taken through the improved switch construction of the present invention, illustrated in its open position.
Figure 1B:
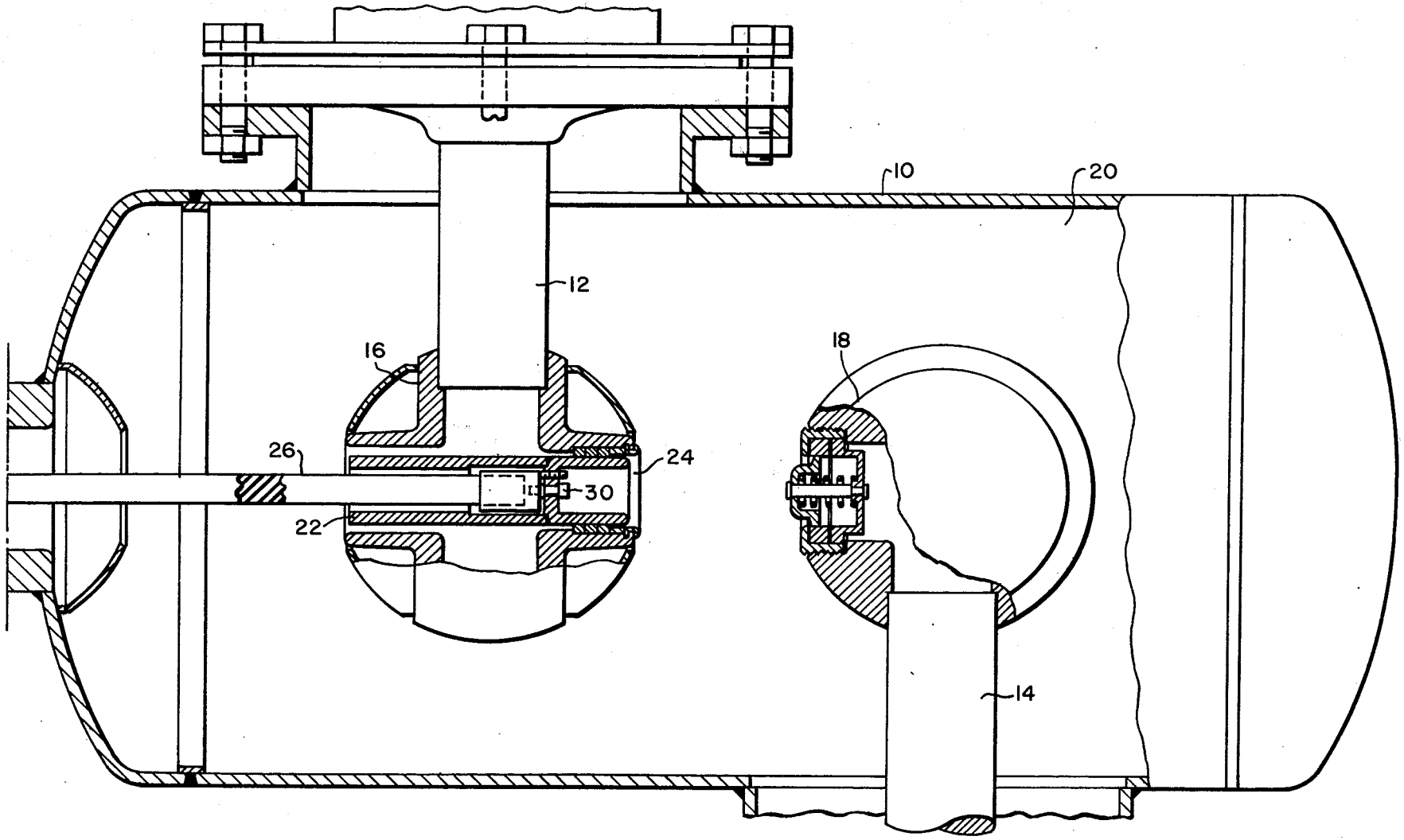

Referring now more particularly to FIG. 1, the magnetizing current switch comprises a sealed housing 10 into which pass two electrical conductors 12, 14 which terminate in generally spherical contact points 16 and 18. For use within a gas insulated substation, for example, the area 20 within the sealed housing 10 would be filled with a quantity of insulating gas such as sulfur-hexafluoride. Disposed within the housing 10 is a movable bridging contact 22 through which electrical connection between the two electrical conductors 12 and 14 is made. The spherical contact point 16 of electrical conductor 12 is constructed so that the movable contact 22 can travel through it and exit at the end 24 nearest the second contact point 18. The contact point 18 for the electrical conductor 14 is constructed so as to receive the movable contact 22 at one end thereof. The electrical conductors 12, 14, the spherical contact points 16, 18, and the movable contact 22 are all good electrically conducting materials such as copper or aluminum.

The movable contact 22 is capable of being in at least two positions. One of the positions is where the movable contact 22 is in electrical contact with both electrical conductors 12 and 14, particularly through the contact points 16 and 18. The second movable contact position is where the movable contact 22 is spaced apart from at least one electrical conductor 12 or 14. As illustrated, the movable contact 22 is spaced apart from the electrical conductor 14 so that electric current cannot flow between the two electrical conductors 12 and 14.

The movable contact 22 is secured to a movable insulating rod 26 which receives motion from the drive means 28 and positions the movable contact 22 in the movable contact positions. The movable contact 22 is preferably secured to the insulating rod 26 by bolts 30. The securing of a contact 22 to the insulating rod 26 by bolts 30 provides for machining tolerances during the manufacture of the component parts, and for slight misalignments in assembling the elements. The movable contact 22 can be assembled and "aimed" by adjusting the bolts 30 so that good contact is made with both spherical contact points 16 and 18.

The insulating rod 26, preferably of a non-electrical conducting material, extends at least from the drive means 28, which are disposed within an operator housing 32 to the movable contact 22. Along the length of insulating rod 26 is a damping system 34 which is utilized to lessen stopping forces exerted on the insulating rod 26 when the rod 26 positions the movable contact 22. The insulating rod 26 is generally positioned within an annular rod housing 36 which extends from the sealed housing 10 to drive means 28 and more particularly to the operator housing 32.

Figure 2:
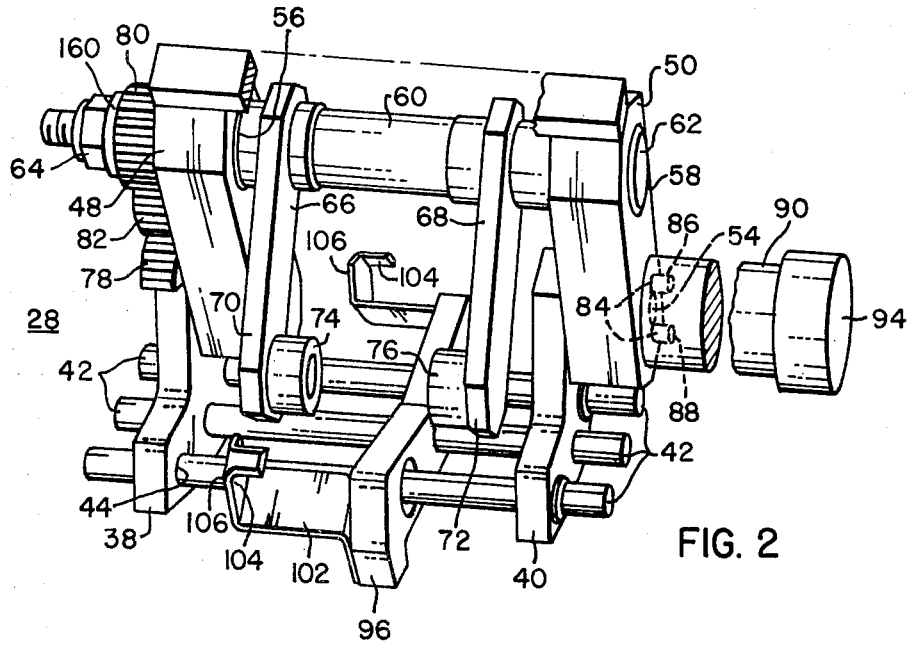
FIG. 2 is a sectional view of the drive means utilized in the invention.
Figure 3:
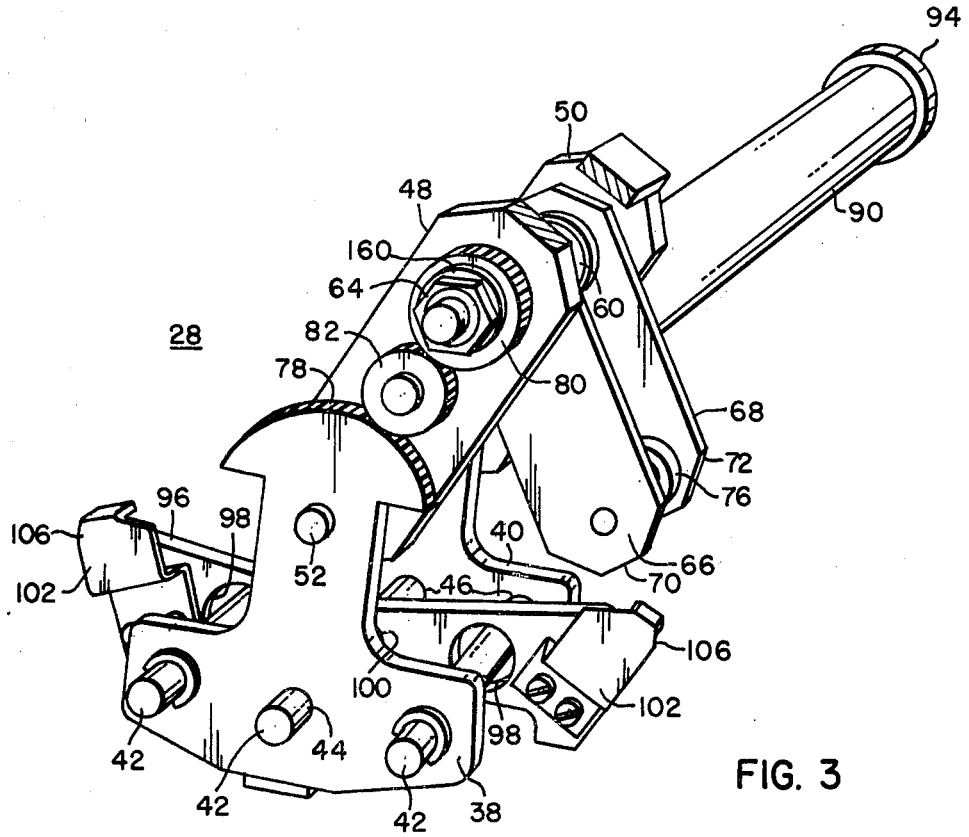
FIG. 3 is a sectional view taken along line III—III of FIG. 2.

The drive means 28 are utilized for positioning the movable contact 22 through the insulating rod 26, and translate the rotational movement of a drive shaft to a generally straight-line motion (see FIGS. 2 and 3). The drive means 28 comprise a pair of spaced-apart parallel support members 38, 40 which are coupled together by a plurality of pins 42. The pins 42 pass through aligned openings 44 and 46 in the support members 38, 40 and into holes (not shown) in the operator housing 32 (see FIG. 1). The pins 42 in the holes of the operator housing 32 maintain the support members 38, 40 in a fixed relationship with respect to the operator housing 32. A pair of parallel, spaced-apart pivot links 48, 50 are pivotally coupled to the support members 38, 40 by means such as the pins 52, 54. The pins 52, 54 enable the pivot links 48, 50 to rotate thereabout in a pivotal motion. The pivot links 48, 50 have aligned openings 56, 58 distal from the pivots pins 52, 54 and through these aligned openings 56, 58 extends a link connector 60. The link connector 60 has a head 62 extending radially outwardly from the opening 58, and a bolt 64 is threaded onto the link connector 60. The bolt 64 forces a locking cone 160 into the gear 80, which locks the gear 80 to the link connector 60. The link connector 60 is permitted a rotational movement within the aligned openings 56, 58 of the pivot links 48, 50. Fixedly secured to the link connector 60 intermediate the pivot links 48, 50 are a pair of parallel, spaced-apart drive arms 66, 68 which rotate upon rotation of the link connector 60. The drive arms 66, 68 have ends 70, 72 distant from the link connector 60, and secured to these ends are a pair of drive rollers 74, 76. The drive bearings 74, 76 cooperate with the insulating rod 26 to position the movable contact 22 either spaced apart, or connected to, the electrical conductors 12, 14.

The support member 38 has a plurality of gear teeth 78 parallel to the pivot link 48. Intermediate the bolt 64 and the pivot link 48, and fixedly secured to the link connector 60, is a rotation gear 80. Intermediate the rotation gear 80 and the support member gear teeth 78, and secured to the pivot link 48, is a secondary gear 82. The gear teeth 78 and gears 80, 82 cooperate to provide rotation of the link connector 60 upon pivotal movement of the pivot links 48, 50. Upon pivotal movement of the pivot link 48 the gear teeth 78 cause the intermediate gear 82 to rotate, which causes the rotation gear 80 to also rotate thereby causing the rotation of the link connector 60.

The pivot link 50 has a plurality of turning pins 84 spaced on either side of the pivot pin 54. The turning pins 84 and the pivot pin 54 are placed within aligned openings 86, 88 in a rotatable drive shaft 90. The rotatable drive shaft 90 extends from the drive means 28, through the operator housing 32 (see FIG. 1) to a turning means 94. The turning means 94 may be manual, such as an operator handle, or mechanical such as a motor. The rotation of the drive shaft 90 by the turning means 94 causes the pivotal movement, or rotation, of the pivot links 48, 50.

The operation of the drive means 28 is substantially as follows. When the drive shaft 90 rotates, the turning pins 84 cause the pivot link 50 to pivot around the pivot pin 54. The pivotal motion of the pivot link 50 causes the corresponding pivotal motion of the pivot link 48 about the pivot pin 52 through their coupling by the link connector 60. The pivotal motion of the pivot links 48, 50 causes a pivotal or arcuate movement of the link connector 60. At the same time, the movement of the pivot link 48 causes the gear teeth 78 and the gears 80, 82 to cooperate to provide a rotational movement of the link connector 60 within the aligned openings 56, 58 of the pivot links 48, 50. This combination of arcuate movement and rotation of the link connector 60 causes the ends 70, 72 of the drive arms 66, 68 to traverse a substantially straight line. The straight-line motion of the distal ends 70, 72 causes a corresponding straight-line movement of the drive rollers 74, 76. Thus, the drive means 28 are utilized to translate the rotational movement of the drive shaft 90 to a generally straight-line movement of the ends 70, 72 of the drive arms 66, 68.

Figure 4:
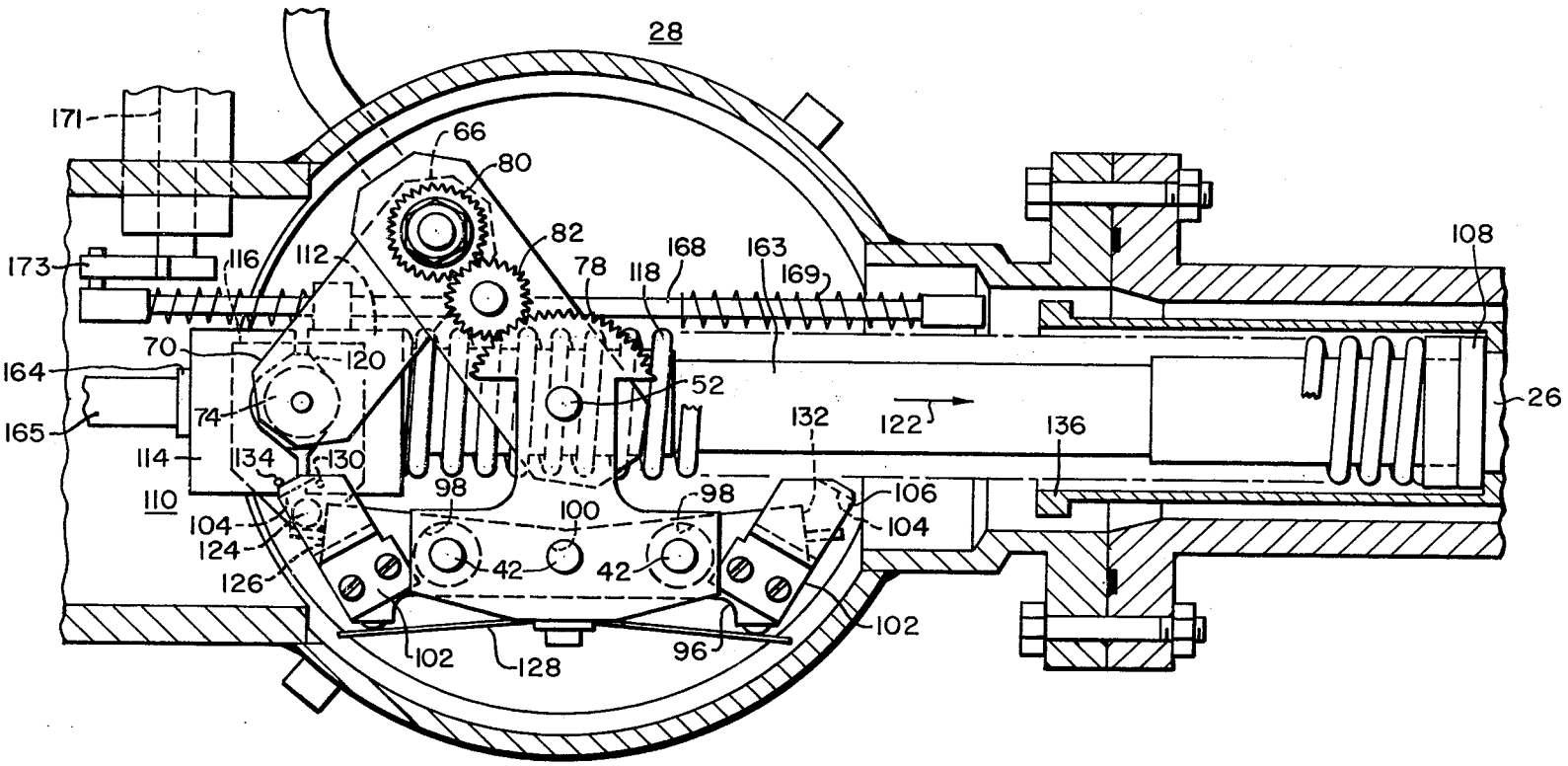
FIG. 4 is a sectional view illustrating the cooperation of the drive means with the insulating rod to position the movable contact.

FIG. 4 illustrates the cooperation of the drive means 28 with the insulating rod 26 to position the movable contact 22. Illustrated is the position of the respective elements in the open position of the movable contact 22. A centrally rotatable latch 96 is positioned intermediate the two drive arms 66, 68, and the latch has openings 98, 100 through which the pins 42 extend. The central opening 100 is close-fit around the central pin 42, while the two outwardly openings 98 are enlarged so that the latch 96 will not contact the pins 42 in these outside openings 98. Thus, the latch 96 is permitted rotational movement about the central pin 42 for a limited distance. The latch 98 has latch fingers 102 fixedly secured thereto, and each latch 102 has a groove 104 at its outermost and downwardly extending edge 106, the operation of which will be described hereinafter.

The insulating rod 26 includes an annular drive collar 108 secured thereto and extending radially outwardly therefrom. The insulating rod 26 also includes a segmented drive block 110 which is comprised of a lead segment 112, a follow segment 114, and a holding block 116. The lead segment 112, the follow segment 114, and the holding block 116, are independent of each other, and movable independently of the other elements. The holding block 116 is disposed between the lead segment 112 and the follow segment 114. The lead segment 112, the holding block 116, and the follow segment 114 have aligned openings (not shown) through which two aluminum tubes 163, 164 attached to the insulating rod 26 pass. The outer tube 163 is fixedly secured to the holding block 116, while the lead segment 112 and follow segment 114 are permitted sliding movement with respect to the tube 163. Intermediate the lead segment 112 and the drive collar 108 is an annular driving spring 118. The driving spring 118 is wrapped around the drive tube 163 and the drive tube 163 passes within the opening of the spring 118.

Upon movement of the drive arm 66, the end of such drive arm 70 and the drive roller 74 attached thereto contacts an arcuate portion 120 on the lead segment 112 and forces the lead segment 112 against the driving spring 118 in the direction indicated by the arrow 122. This movement causes a compression of the driving spring 118 against the drive collar 108. Normally, this would cause a movement of the drive collar 108 and the insulating rod 26 attached thereto would move. However, the holding block 116 has an outwardly extending pin 124 which comes into mechanical contact with an edge 126 of the latch 96. The latch 96, has biasing means 128, such as a centrally mounted spring and a back angle on the face of the latch 96, which prohibit the rotation of the latch 96 away from the pin 124 to permit it 124 to proceed. Therefore, the latch 96 stops movement of the holding block 116. Since the holding block 116 is secured to the insulating rod 26, the insulating rod 26 is not permitted to move. Thus, the lead segment 112 will continue compressing the spring 118, creating a large driving force against the drive collar 108. This compression will continue until the lead segment 112 is positioned adjacent to the latch finger 102 of the latch 96. When the lead segment 112 is opposite the latch finger 102, a lifting pin 130 on the lead segment 112, which extends outwardly therefrom towards the latch finger 102, will come in contact with the latch finger 102 and more particularly with the groove 104. As the lifting pin 130 is in the groove 104, and further movement of the lead segment 112 occurs, the lifting pin 130 will reach the downwardly extending portion 106 of the latch finger 102. At this time, since the lifting pin 130 moves in a straight line, the lifting pin 130 will raise the downwardly extending portion 106 of the latch finger 102. This lifting of the latch finger 102 causes the latch 96 to rotate about the centrally disposed pin 42. This causes the latch portion 126 holding the pin 124 of the holding block 116 to move away from the pin 124, and the force maintaining the holding block 116 in its spatial position is removed. Once this force is removed, the compressed force of the drive spring 118 against the collar 108 causes a rapid movement of the insulating rod 26 and the holding block 116 attached thereto. This force will cause the holding block 116 to traverse the entire distance of the latch 96, and the movement contact 22 will then be able to come into electrical contact with both electrical conductors 12, 14. The holding block 116 is then prevented from returning to a centrally disposed location by the return action of the latch 96. Once the holding block 116 passes the position opposite the latch finger 102, it moves the lead segment 112 along with it. The movement of the lead segment 112 moves the lifting pin 130 away from the groove 104 in the latch finger 102, thereby removing the rotational force and the latch 96 returns to its original position. In this position, backward movement of the holding block 116 is prevented because the opposite latch edge 132 comes into contact with the pin 124 and prevents the movement of the holding block 116. This latch contact will then maintain the position of the movable contact 22 connected to both electrical conductors 12, 14.

When it is desired to move the movable contact 22 to its spaced-apart position, a reverse process occurs. The follow segment 114, attached to the inner tube 164 and pinned to the collar 108, is then moved by the action of the drive arm 66 and the drive bearing 74 in the direction opposite to the arrow 122 thereby compressing spring 118. The follow segment also has a lifting pin 134 which will come in contact with a groove (not shown) on the other latch finger (108), which will then cause a rotation of the latch and a release of the holding block 116.

Figure 5:
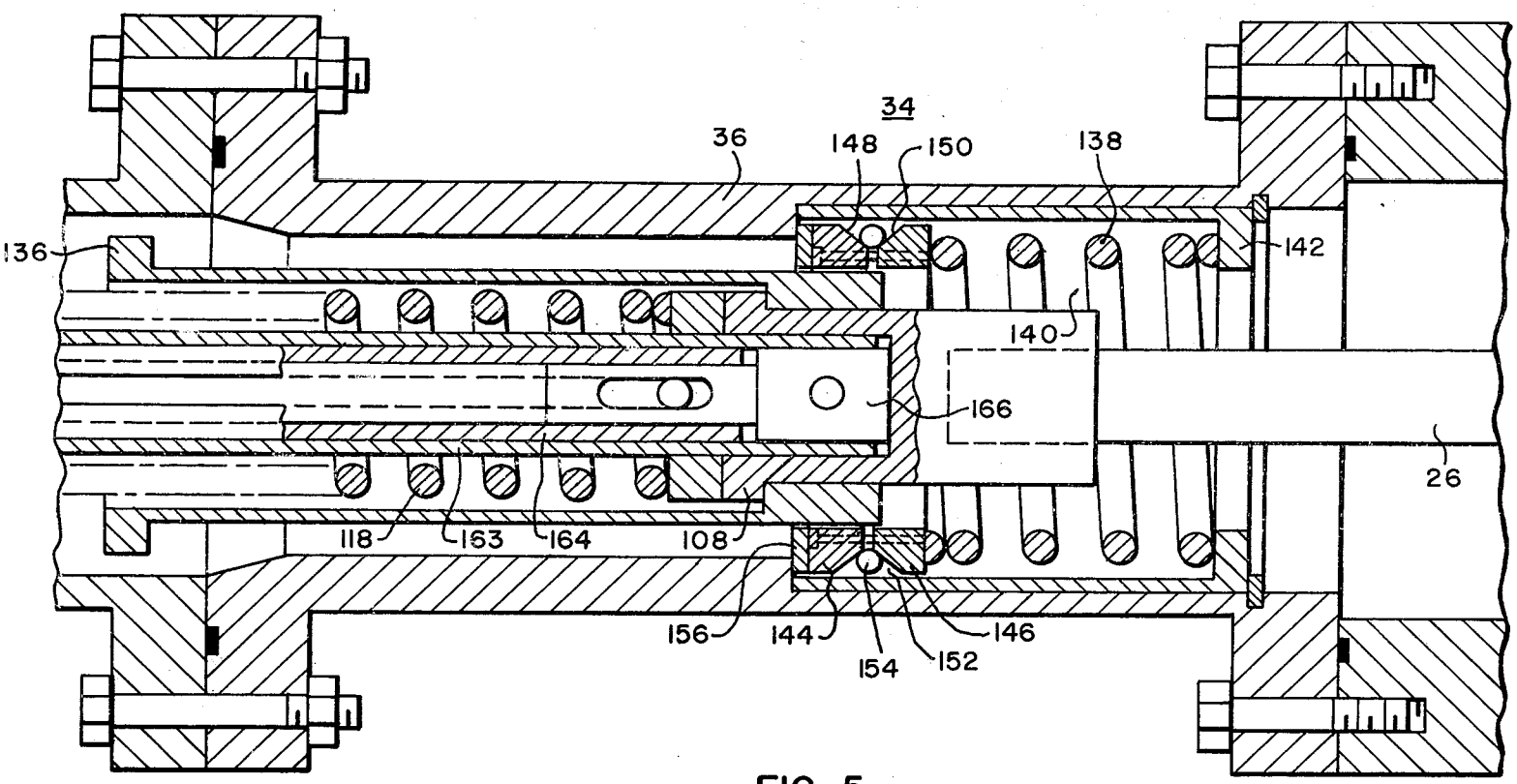
FIG. 5 is a detail illustration of damping means utilized to lessen stopping forces on the insulating rod.

Upon the release of the insulating rod 26, the insulating rod moves at a rapid speed, and damage would occur to the movable contact 22 upon impact with the contact point 18 unless damping and stopping means were utilized to slow down and stop the movement of the insulating rod 26 at the proper position. This deceleration and stopping function is performed by the damping system 34 (see FIG. 5). The damping system utilizes a dry mechanical friction of a plurality of ball bearings spaced between two annular scoped rings which force the ball bearings into the inside periphery of the outer cylinder housing, the entire assembly being loaded by a spring. The damper is not affected by changes in gas pressure or temperature.

The damping system 34 is disposed within the annular rod housing 36. The insulating rod 26 has a damping collar 136 secured thereto and extending radially outwardly therefrom. As such, the damping collar 136 travels with the insulating rod 26. The damping system 34 also includes an annular damping spring 138 disposed within the rod housing 36 and adjacent thereto. The insulating rod 26 travels within an opening 140 inside the damping spring 138. At one end of the damping spring 138, and fixedly secured to the rod housing 36, is an annular stopping block 142. At the other end of the damping spring 138 are a pair of annular impacter blocks 144, 146. The impacter blocks 144, 146 are positioned within the rod housing 36 and, additionally, are positioned adjacent to each other. The impacter blocks 144, 146 extend radially inwardly from the rod housing 36 towards the insulating rod 26 but do not contact the insulating rod 26. However, the impacter blocks 144, 146 will contact the damping collar 136 as the damping collar 136 passes adjacent the impacter blocks 144, 146.

Each impacter block 144, 146 has an angular section 148, 150 removed therefrom. The angular section 148, 150 is removed from adjacent to the rod housing 36 and the other impacter block 146, 144 respectively. What is thereby formed is a generally triangular gap 152 formed between the impacter blocks 144, 146 and the rod housing 36. Disposed within this triangular gap are a plurality of ball bearings 154. A buffer washer 156 is positioned on the impacter block 144 intermediate the impacter block 146 and the damping collar 136 to limit initial acceleration of the impacters 144, 146.

The operation of the damping system 34 is substantially as follows. Upon movement of the insulating rod 26, the damping collar 136 will contact the buffer washer 156 and the impacter block 144. The impacter block 144 will contact the second impacter block 146, pushing the two impacter blocks 144, 146 together and against the ball bearings 154. The ball bearings 154 will then permit movement of the damping collar 136 and the impacter blocks 144, 146 against the damping spring 138, thereby rubbing the bearings 154 against the housing 34. This movement against the damping spring 138 will cause a compression of the damping spring 138, and, together with the friction of the bearings 154, will dissipate energy and cause a deceleration and eventual stoppage of the movement of the impacter blocks 144, 146 and the damping collar 136. The stoppage of the damping collar 136 will cause the insulating rod 26 attached thereto to also stop. By properly sizing the damping spring 138 and using a proper angle on the sections 148, 150, the desired deceleration forces and stopping distances can be achieved so that the movable contact 22 will not be damaged when moved into its position in the electrical contact with the contact point 18. Damping for the opening of the switch is accomplished by the damper 161. The damper 161 is actuated by the rod 165 being pushed upon by the insulating rod 26 through the intermediate blocks 166, 167 at the end of opening travel, in a manner similar to that described for closing the switch.

Figure 6:
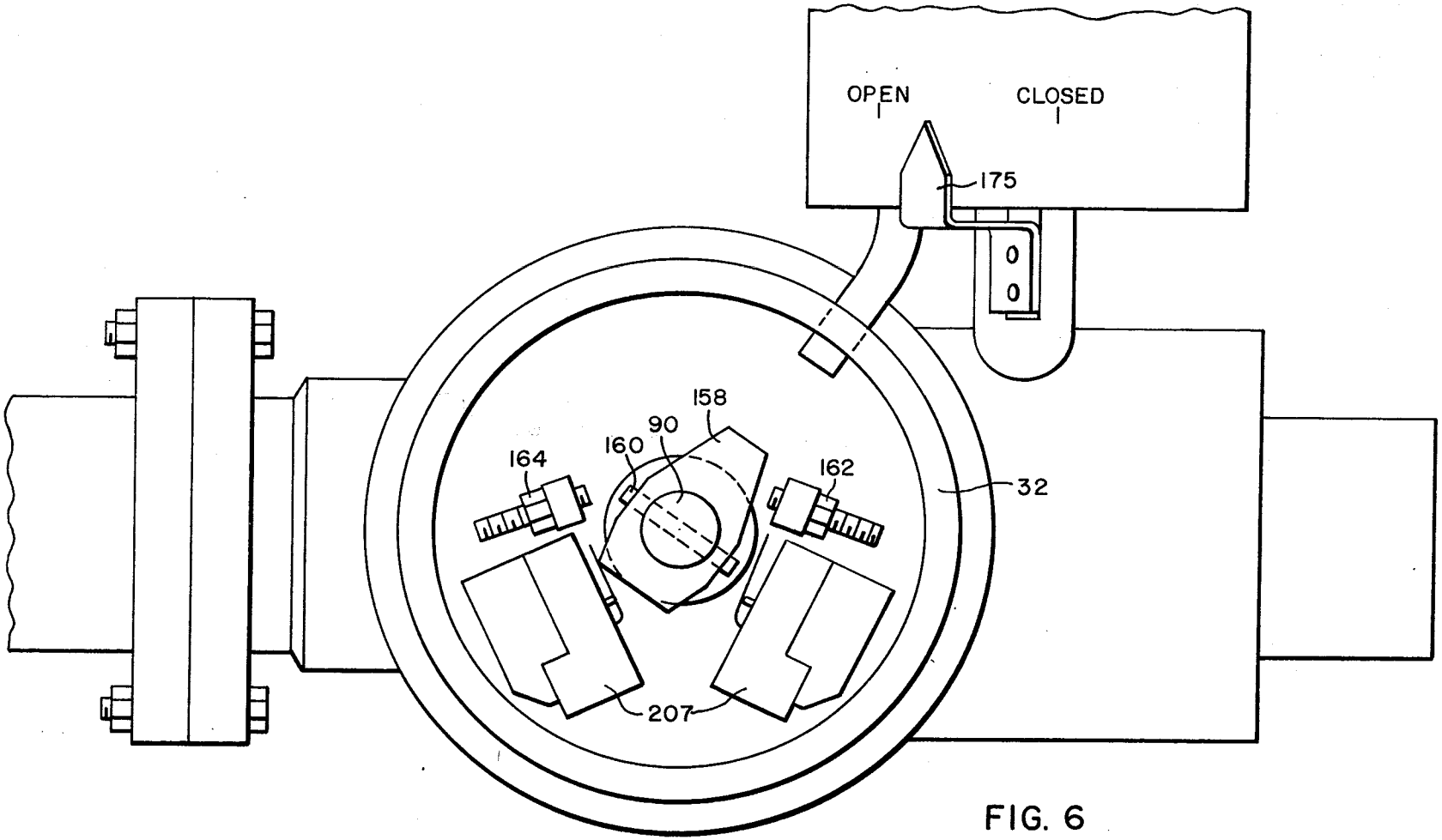
FIG. 6 is a detail illustration of the adjustable stop utilized in conjunction with the drive shaft to prohibit the imposition of high loads on the switching terminals.

An auxiliary feature of the magnetizing current switch of the invention is illustrated in FIG. 6. FIG. 6 illustrates the drive shaft 90 extending outwardly from the operator housing 32. The drive shaft 90 has a shaft extension 158 attached thereto by means such as the pin 160. Secured to the exterior of the operator housing 32 are adjustable stops 162, 164. These adjustable stops 162, 164 are disposed around the drive shaft 90 and shaft extension 158 so that the shaft extension 158 cannot rotate beyond the adjustable stops 162, 164. This prohibits the drive shaft 90 from excess rotation, and thereby imposing high stresses upon the drive means 28. The stops 162, 164 set a definite end of rotation of the drive shaft 90. Additionally, the stops are adjustable to permit modification of the magnetizing current switch. As heretofore described, the latch 96 illustrated in FIG. 4, is of a one-piece construction. Therefore, to modify the magnetizing current switch so as to permit a changed length of stroke, all that is required is that the one-piece latch 96 be removed, the new length latch be installed in its place, and the stops 162, 164 can be adjusted for this new mechanism stroke. This additional feature compensates for errors in manufacturing and fabrication, and also permits modification of the switch for use in varied installations.

Limit switches 207 are provided, and are actuated by the shaft extension 158 to give an electrical indication of shaft 90 movement. This provides added protection from unwanted operation of the magnetizing current switch when installed in a substation where unwanted action would cause damage.

Position indication switches 170 are incorporated to give an indication of the contact 24 position. The position indication switches 170 are activated by rod 168 which slides through a guide 174 attached to the holding block 116. As the magnetizing current switch operates, the guide 174 slides over the rod 168 until it impacts a spring 169 which abuts against the end of rod 168. This action applies a load to rod 168, which then pivots a lever 173. Pivoting of the lever 173 causes a rotation of shaft 171 to which the lever 173 is attached, and rotation of the shaft 171 causes cams 172 attached thereto to also rotate. The rotation of the shaft 171 actuates the electrical auxiliary position switches 170, and rotation of the cams 172 causes actuation of the mechanical position indicator 175.

Thus, the disclosed invention illustrated an improved magnetizing current switch which is particularly adapted for use in compressed gas insulated systems.

We claim as our invention:

1. A magnetizing current switch comprising:

a sealed housing including two spaced-apart electrical conductors;

a movable contact disposed within said sealed housing and capable of being in two positions, one of said contact positions being in electrical contact with both of said conductors to permit the flow of electric current therebetween, the other of said contact positions being spaced apart from at least one of said conductors to prohibit the flow of electric current therebetween;

a rotatable drive shaft;

turning means for rotating said drive shaft;

drive means, coupled to said drive shaft, for positioning said movable contact, said drive means translating said shaft rotation to a generally straight-line motion; and a movable insulating rod secured to said movable contact and coupled to said drive means, said straight-line motion of said drive means positioning said movable contact through said insulating rod.

2. The switch according to claim 1 wherein said drive means comprises:

a pair of fixed, spaced-apart parallel support members coupled together;

a pair of parallel, spaced-apart pivot links pivotally coupled to said support members, one of said pivot links being coupled to said drive shaft and pivotally moved thereby, said pivot links having aligned openings therein distal from said pivotal coupling to said support members;

a link connector positioned within a pivot link openings and securing said pivot links to each other, said link connector being capable of rotational movement within said pivot link openings, said link connector having an arcuate movement upon pivotal movement of said pivot links and rotating within said pivot link openings; and a pair of parallel, spaced-apart drive arms fixedly secured to said link connector and having ends distant from said link connector, said arcuate movement and rotation of said link connector causing a generally straight-line movement of said drive arm ends, said drive arm ends being coupled to said insulating rod and positioning said movable contact through said insulating rod.

3. The switch according to claim 2 wherein one of said support members has a plurality of gear teeth thereon parallel to said pivot links; and said link connector has one or more rotation gears coupled thereto adjacent said pivot link and said support member, said rotation gears and said support member gear teeth cooperating to permit rotation of said link connector upon pivot link motion.

4. The switch according to claim 1 wherein said insulating rod is secured to said movable contact by bolts.

5. The switch according to claim 1 wherein a damping system is utilized to lessen stopping forces exerted on said insulating rod, said damping system comprising:

an annular rod housing extending from said sealed housing to said drive means, and insulating rod traveling within said rod housing;

a damping collar secured to said insulating rod and extending radially outwardly therefrom, said damping collar traveling with said insulating rod;

an annular damping spring disposed within said rod housing and positioned adjacent thereto, said insulating rod traveling within said damping spring;

a pair of annular impacter blocks positioned within said rod housing intermediate said damping spring and said damping collar, said blocks positioned adjacent to each other and to said rod housing, each impacter block having an angular section removed therefrom adjacent the other impactor block and said rod housing, said impacter blocks and said rod housing forming a generally triangular gap therebetween, said impacter blocks extending radially inwardly towards said insulating rod, said insulating rod traveling within said impacter blocks; and a plurality of bearings disposed within said triangular gap, said damping collar upon movement of said insulating rod contacting said impacter blocks and moving said impacter blocks against said bearings, said bearings dissipating energy through friction with said rod housing and facilitating movement of said impacter blocks against said damping spring to compress said damping spring.

6. The switch according to claim 1 including:

an annular drive collar secured to said insulating rod and extending radially outwardly therefrom;

a drive tube selected to said insulating rod and extending through said drive means;

an annular driving spring positioned around said drive tube intermediate said drive means and said drive collar, said drive means compressing said driving spring to provide a force for moving said insulating rod; and a centrally rotatable latch having biasing means attached thereto, said latch being positioned adjacent said drive tube, said latch preventing movement of said drive tube and said insulating rod until said driving spring is compressed.

7. The switch according to claim 6 including a segmented drive block having a lead segment and a follow segment having aligned openings therein being positioned on said drive tube, said drive tube extending through said aligned segment openings, said lead and follow segments being movable along said drive tube, said drive means being positioned intermediate said segments and moving said lead segment against said driving spring to compress said driving spring against said drive collar; and a holding block having an opening therethrough through which said drive tube extends, said holding block being fixedly secured to said drive tube and positioned intermediate said lead and follow segments, said holding block having an outwardly extending pin, said latch contacting said holding block pin to prevent movement of said holding block until said driving spring is compressed.

8. The switch according to claim 7 wherein said latch has a latch finger fixedly secured thereto and extending outwardly and downwardly therefrom adjacent said drive block, said latch finger having a groove therein; and said lead segment has a lifting pin extending outwardly therefrom adjacent to said latch finger, said lifting pin capable of being positioned in said latch finger groove, whereby upon compression of said driving spring, said lifting pin is positioned in said latch finger groove and exerts a force thereon, said lifting pin force causing said latch to rotate, said latch rotation causing said latch to become spaced apart from said holding block pin and permitting movement of said holding block, said drive tube, and said insulating rod.

9. The switch according to claim 6 wherein said latch is of a one-piece construction.

10. The switch according to claim 1 wherein said drive means are disposed within an operator housing, said drive shaft extends from said drive means through said operator housing to the exterior of said operator housing;

a shaft extension is secured to said drive shaft external of said operator housing and extending radially outwardly from said drive shaft; and an adjustable stop is secured to the exterior of said operator housing, said adjustable stop extending outwardly from said operator housing adjacent said shaft extension, said adjustable stop prohibiting movement of said shaft extension beyond said adjustable stop, whereby said adjustable stop sets a definite end of rotation of said shaft.

11. The switch according to claim 7 including a position indicating system coupled to said holding block, said position indicating system being responsive to movement of said holding block to indicate position of said holding block, the position of said holding block indicating the position of said movable contact.

* * * * *

Dedication 4,029,923.—*Jeffry R. Meyer,* Pittsburgh and *Sylvester J. Dropik,* Jeannette, Pa. MAGNETIZING CURRENT SWITCH. Patent dated June 14, 1977. Dedication filed July 21, 1982, by the assignee, *Westinghouse Electric Corp.*

Hereby dedicates to the Public the entire term of said patent.

[*Official Gazette April 24, 1984.*]